US006471787B2

(12) United States Patent
Cicale'et al.

(10) Patent No.: US 6,471,787 B2
(45) Date of Patent: Oct. 29, 2002

(54) PROCESS FOR THE PRODUCTION OF ORIENTED-GRAIN ELECTRICAL STEEL SHEET WITH HIGH MAGNETIC CHARACTERISTICS

(75) Inventors: Stefano Cicale', Rome; Stefano Fortunati, Ardea; Giuseppe Abbruzzese, Montecastrilli, all of (IT)

(73) Assignee: Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/331,506

(22) PCT Filed: Jul. 24, 1997

(86) PCT No.: PCT/EP97/04007

§ 371 (c)(1),
(2), (4) Date: Jun. 22, 1999

(87) PCT Pub. No.: WO98/28452

PCT Pub. Date: Jul. 2, 1998

(65) Prior Publication Data

US 2002/0033206 A1 Mar. 21, 2002

(30) Foreign Application Priority Data

Dec. 24, 1996 (IT) ..... RM96A0904

(51) Int. Cl.[7] ..... H01F 1/04

(52) U.S. Cl. ..... 148/113; 148/111; 148/112

(58) Field of Search ..... 148/111, 112, 148/113

(56) References Cited

U.S. PATENT DOCUMENTS

| | | | | |
|---|---|---|---|---|
| 3,841,924 A | | 10/1974 | Sakakura et al. | |
| 4,225,366 A | | 9/1980 | Harase et al. | |
| 4,623,406 A | | 11/1986 | Suga et al. | |
| 4,979,996 A | * | 12/1990 | Kobayashi et al. | 148/111 |
| 4,979,997 A | * | 12/1990 | Kobayashi et al. | 148/111 |
| 5,082,509 A | * | 1/1992 | Ushigami et al. | 148/111 |
| 5,186,762 A | * | 2/1993 | Ushigami et al. | 148/111 |

* cited by examiner

*Primary Examiner*—John Sheehan
*Assistant Examiner*—Andrew L. Oltmans
(74) *Attorney, Agent, or Firm*—Hedman & Costigan, P.C.

(57) ABSTRACT

A process for the production of oriented-grain electrical steel sheet with high magnetic characteristics, and more precisely a process in which the slab obtained from continuous casting is continuously nitrided by a reaction between aluminium and nitrogen is described. Amount, size and distribution of precipitates are controlled, enabling a high-temperature continuous heat treatment during which the primary-recrystallization and a high-temperature nitriding are realized.

14 Claims, No Drawings

PROCESS FOR THE PRODUCTION OF ORIENTED-GRAIN ELECTRICAL STEEL SHEET WITH HIGH MAGNETIC CHARACTERISTICS

The present application is the national stage filing of and claims priority to International Application No. PCT/EP97/04007, filed Jul. 24, 1997 and Italian Application Ser. No. RM96A000904, filed Dec. 24, 1996.

The present application is related Applicant's copending U.S. application Ser. Nos. 09/243,000, filed Feb. 26, 1999 now U.S. Pat. No 6,296,719; 09/242,992, filed Feb. 26, 1999 now U.S. Pat. No. 6,273,964; 09/331,273, filed Jun. 17, 1999 now U.S. Pat. No. 6,406,557; 09/381,109, filed Dec. 9, 1999now U.S. Pat. No. 6,148,682; 09/381,104, filed Dec. 9, 1999 now U.S. Pat. No. 6,361,620 and 09/331,504, filed Jun. 22, 1999 now U.S. Pat. No. 6,325,866.

FIELD OF THE INVENTION

The present invention relates to a process for the production of oriented-grain electrical steel sheet with high magnetic characteristics, and more precisely to a process in which the slab obtained from continuous casting is annealed at a temperature that enables dissolution of part of the sulphides and nitrides present, to be subsequently re-precipitated in a form that is suitable for controlling the grain size during decarburization annealing, and which enables a subsequent high-temperature continuous heat treatment phase during which, by nitrogen diffusion throughout the thickness of the strip, aluminium is directly precipitated as nitride, complementing the second-phases fraction necessary to control the grain orientation in the end product.

STATE OF PRIOR ART

Oriented-grain silicon steel for electrical applications is generically classified into two categories, basically differentiated by the value of magnetic induction measured under the action of a magnetic field of 800 amp-turn/m, designated with the code B800: the category of conventional oriented-grain silicon steel, with B800 less than 1890 mT, and that of high-permeability oriented-grain silicon steel, with B800 higher than 1900 mT. Further subdivisions exist according to the so-called core losses, which are expressed in W/kg.

Conventional oriented-grain silicon steel, introduced in the thirties, and the super-oriented grain silicon steel having better permeability, introduced industrially in the second half of the sixties, are basically used for the production of cores, for electric transformers, the advantages of the super-oriented grain product regarding the higher permeability, which makes possible smaller-sized cores and lower losses, with resultant energy saving.

In electrical strips, permeability is a function of the orientation of the body-centered cubic crystals (grains) of iron, which must have a corner parallel to the direction of rolling. By using certain appropriately precipitated precipitates (inhibitors), the so-called second phases, which reduce the mobility of the grain boundaries, selective growth is obtained only of the grains having the desired orientation. The higher the temperature of dissolution in the steel of these precipitates, the greater the uniformity of orientation, and the better the magnetic characteristics of the end product. In the oriented-grain steel, the inhibitor consists prevalently of manganese sulphides and/or selenides, whilst in the super-oriented grain steel the inhibitor consists primarily of aluminium containing nitride.

However, in the production of super-oriented electrical strips, -during solidification of the liquid steel and the subsequent cooling of the resultant solid, the sulphides and aluminium nitride are precipitated in a coarse form, unsuitable for the desired purposes. They must therefore be redissolved and re-precipitated in the right form, and kept in this state up to the moment when grains of the desired size and orientation are obtained, in a final annealing stage, after cold-rolling to the desired final thickness and decarburization annealing, at the end of a complex and costly process of transformation.

It is evident that the production problems, which basically regard the difficulty of obtaining good yields and a constant quality, are to a large extent due to the necessary precautions to be taken to keep the aluminium nitride in the required form and distribution during the entire process of steel transformation.

To reduce these problems, a technology has been developed in which the aluminum nitride suitable for controlling the growth of the grains is produced via nitriding of the strip, preferably after cold-rolling, as described in U.S. Pat. Nos. 4,255,366, 3,841,924 4,623,406 and in European Pat. No. EP0339 474.

In the latter patent, the aluminium nitride, which is coarsely precipitated during the slow solidification of the steel, is kept in this state by the low temperature adopted for heating the slabs (i.e., lower than 1280° C., preferably lower than 1250° C.) before hot-rolling. After decarburization annealing, nitrogen is introduced, which immediately reacts producing, mainly in the surface layers of the strip, silicon nitrides and manganese and silicon nitrides, which have a relatively low solubilization temperature and which are dissolved in the final box annealing. The nitrogen thus liberated diffuses throughout the strip and reacts with the aluminium, re-precipitating in a fine and homogeneous form throughout the thickness of strip as a mixed aluminium and silicon nitride. This process entails the need to keep the material at 700–800° C. for at least four hours. In the above patent, it is stated that the temperature of introduction of the nitrogen must be close to the decarburization temperature (approx. 850° C.), and at all events certainly not higher than 900° C., to prevent an uncontrolled growth of the grains, in view of the lack of suitable inhibitors. Actually, the optimal nitriding temperature appears to be 750° C., whereas 850°C. is an upper limit, in order to prevent such uncontrolled growth. EP Application 539.858 follows the general ideas of the above EP Patent, imposing some further limitations on slab heating temperatures, at or below 1200 ° C.

U.S. Pat. Nos. 3,841,924 and 4,623,406 refer to a more classic process, in which the inhibitor is formed at the stage of hot rolled strip and there is no nitriding before final secondary recrystallization.

This process seems to involve certain advantages, such as the relatively low temperatures of heating of the slab before hot rolling, of decarburization and of nitriding as well as the fact that the need to keep the strip during box-annealing at a temperature of between 700° C. and 800° C. for at least four hours (with the aim of obtaining the mixed nitrides of aluminium and silicon necessary for controlling grain growth) does not add to the production cost, in so far as the heating of the box-annealing furnaces requires similar lengths of time in any case.

However, along with the advantages referred to above, there are also a number of disadvantages, among which: (i) owing to the low temperature of heating of the slabs, the sheet is very poor in precipitates useful as inhibitors of grain growth; consequently, all the strip heating cycles, in particular in the decarburization and nitriding processes, must be carried out at relatively low and critically controlled temperatures, in that in such conditions, the grain boundaries are very mobile, which implies the risk of an uncontrolled grain growth; (ii) it is impossible to introduce, in the final annealings, any improvements that might accelerate the heating times; for example, by replacing box-annealing furnaces with other furnaces of a continuous type.

DESCRIPTION OF THE INVENTION

The present invention aims at overcoming the drawbacks of the known production systems by proposing a process in which a slab of silicon steel for electrical applications is heated evenly at a temperature that is decidedly higher than the one adopted in cited know processes involving strip nitriding, but lower than the temperature of the classic process of production of high-permeability steel sheet, and then hot-rolled. The strip thus obtained undergoes two-stage rapid annealing followed by quenching, and is then cold-rolled, if necessary with a number of rolling steps at a temperature of between 180° C. and 250° C. The cold-rolled sheet first undergoes decarburization annealing and then nitriding annealing at a high temperature in an atmosphere containing ammonia.

There follow the usual final treatments, among which the deposition of the annealing separator and the secondary-recrystallization final annealing.

The present invention refers to a process for producing steel sheet with high magnetic characteristics in which a silicon steel containing from 2.5% to 4.5% of silicon; from 150 to 750 ppm, preferably from 250 to 500 ppm, of C; from 300 to 4000 ppm, preferably from 500 to 2000 ppm, of Mn; less than 120 ppm, preferably from 50 to 70 ppm, of S; from 100 to 400 ppm, preferably from 200 to 350 ppm, of $Al_{sol}$; from 30 to 130 ppm, preferably from 60 to 100 ppm, of N; and less than 50 ppm, preferably less than 30 ppm, of Ti; the remainder consisting of iron and minor impurities, undergoes continuous casting, high-temperature annealing, hot-rolling, cold-rolling in a single stage or in more than one stage. The cold-rolled strip thus obtained undergoes continuous annealing to carry out a primary recrystallization and decarburization, is coated with annealing separator, and box-annealed for a secondary-recrystallization final treatment, characterized by the combination in cooperation relationship of the following stages:

(i) carrying out on the thus obtained slabs an equalization heat treatment at a temperature of between 1200° C. and 1320° C., preferably between 1270° C. and 1310° C.;

(ii) hot-rolling the slabs thus obtained, and coiling the resultant strip at a temperature of less than 700° C., preferably lower than 600° C.;

(iii) carrying out a fast heating of the hot-rolled strip at a temperature of between 1000° C. and 1150° C., preferably of between 1060° C. and 1130° C, with subsequent cooling down to and stopping at a temperature of between 800° C. and 950° C., preferably of between 900° C. and 950° C., followed by quenching, preferably in water and water vapor, starting from a temperature of between 700° C. and 800° C.;

(iv) carrying out cold-rolling in at least one stage;

(v) carrying out continuous decarburization annealing of the cold-rolled strip for a total time of between 50 and 350 sec., at a temperature of between 800° C. and 950° C. in a wet nitrogen-hydrogen atmosphere, with $pH_2OpH_2$ ranging between 0.3 and 0.7;

(vi) carrying out continuous nitriding annealing at a temperature of between 850° C. and 1050° C., for a period of time of between 15 and 120 sec., feeding into the furnace a nitrogen-hydrogen based gas containing $NH_3$ in quantities of between 1 and 35, preferably between 1 and 9, standard liters per kg of strip, with a water vapor content of between 0.5 and 100 $g/m^3$;

(vii) carrying out the usual final treatments including secondary-recrystallization annealing. During this annealing, heating at a temperature of between 700° C. and 1200° C. takes place in a period of time of between 2 and 10 hours, preferably of less than 4 hours.

The continuously cast slabs preferably have the following controlled composition: Si, from 2.5% to 3.5% bw; C, between 250 and 550 ppm; Mn, between 800 and 1500 ppm; soluble Al, between 250 and 350 ppm; N, between 60 and 100 ppm; S, between 60 and 80 ppm; and Ti, less than 40 ppm; the remainder consisting of iron and minor impurities.

Preferably, cold-rolling takes place in a single stage, with the cold-rolling temperature kept at a value of at least 180° C. in at least one part of the rolling passes; in particular, in two intermediate rolling passes the temperature is between 200° C. and 220° C.

Preferably, the decarburization temperature is between 830° C. and 880° C., whilst nitriding annealing is preferably carried out at a temperature of 950° C. or higher. The bases of the present invention may be explained as follows. It is deemed important to keep a certain quantity, not minimal, of inhibitor suitable for controlling grain growth in the steel up to continuous nitriding annealing. Such inhibitors make it possible to work at relatively high temperatures, at the same time avoiding the risk of an uncontrolled grain growth, which would imply severe losses in terms of yield and magnetic qualities. This is theoretically possible in a number of different ways, but for the purposes of the present invention, the choice has been to operate keeping the temperature for heating the slabs at a value high enough to o solubilize a significant quantity of inhibitors, but still low enough to prevent formation of liquid slag and the consequent need to use costly special furnaces The subsequent precipitation of these inhibitors makes it possible, among other things, to increase the nitriding temperature to a value at which precipitation of aluminum as nitride is obtained directly, and to increase the rate of penetration and diffusion of the nitrogen in the strip. The second phases present in the matrix serve as nuclei for said precipitation, which is induced by the diffusion of the nitrogen, also enabling a more uniform distribution of the absorbed nitrogen throughout the thickness of the strip.

process according to the present invention will now be illustrated in the following examples, which, however, are mere illustrations and do not limit the possibilities.

EXAMPLE 1

A number of steels were produced, the composition of which is given in Table 1:

Two slabs for each composition were heated to 1300° C. with a cycle lasting 200 minutes, and directly hot-rolled to a thickness of 2.1 mm.

The hot-rolled strips underwent a two-stage annealing, with a first pause at 1100° C. for 30 sec. and a second pause at 920° C. for 60 sec., followed by quenching, starting from 750° C., in water and water vapor, sand-blasting and pickling.

The strips then underwent single-stage cold-rolling in five passes, the third and fourth of which being carried out at 210° C., down to a thickness of 0.30 mm.

The cold-rolled strips underwent decarburization annealing at 870° C. for 180 sec. and, subsequently, nitriding annealing at 1000° C. for 30 sec., in an atmosphere fed into the furnace consisting of nitrogen and hydrogen containing 8% vol. of $NH_3$, with a dew point of 10° C.

The strips were then coated with annealing separator and box-annealed according to the following heat cycle: rate of heating 15° C./sec. in an atmosphere of 25% $N_2$ and 75% $H_2$ up to 1200° C., after which the strips are left to stand for 20 hours at this temperature in pure hydrogen.

Table 2 below shows the mean magnetic characteristics obtained.

EXAMPLE 2

A strip of composition 4, treated up to decarburization according to the previous example, underwent nitriding annealing at the temperatures of 770° C., 830° C., 890° C., 950° C. 1000° C. and 1050° C. for 30 sec. in a nitrogen-hydrogen atmosphere containing 7% vol. of $NH_3$, with a dew point of 10° C. On the products, the following values were determined: absorbed nitrogen (A); nitrogen absorbed as aluminium nitride (B); and the permeability obtained (see Table 3).

EXAMPLE 3

The hot-rolled strip of composition 4 of Example 1 was cold-rolled to the thicknesses of 0.30, 0.27, and 0.23 mm. The cold-rolled strips were decarburized at 850° C. for 180 sec. in a wet nitrogen-hydrogen atmosphere and underwent nitriding annealing at 1000° C. for 30, 20, and 23 sec., according to the thickness.

The amounts of absorbed nitrogen and the magnetic permeability values obtained are given in Table 4.

EXAMPLE 4

Steel 2 of Table 1 was brought up to decarburization according to Example 1, and then underwent nitriding by feeding into the furnace a nitrogen-hydrogen atmosphere containing 8% vol. of $NH_3$, with a dew point of 10° C., at two different temperatures: A) 1000° C.; B) 770° C.

Each strip then underwent two final annealings:

1) heating rate of 15° C./h in an atmosphere of 25% $N_2$ and 75% $H_2$ up to 1200° C., and left to stand for 20 hours at this temperature in pure hydrogen;

2) heating rate of 15° C./h in an atmosphere of 25% $N_2$ and 75% $H_2$ up to 700° C., heating rate of 250° C./h up to 1200° C., and left to stand for 20 hours at this temperature in pure hydrogen.

The permeability values, expressed in mT, that were obtained are shown in Table 5.

EXAMPLE 5

A steel having the following composition was continuously cast: Si, 3.2% bw; C, 500 ppm; Mn, 0.14% bw; S, 75 ppm; $Al_{sol}$, 290 ppm; N, 850 ppm; and Ti, 10 ppm; the remainder consisting of iron and inevitable impurities. The slabs were heated to A) 1150° C. and B) 1300° C., with a cycle lasting 200 minutes. The strips were then treated according to Example 1 up to the cold-rolled state, and then underwent decarburization at 840° C. for 170 sec., and immediately afterwards nitriding 1) at 850° C. for 20 sec., and 2) at 1000° C. for 20 sec.

After the usual final treatments, the magnetic characteristics were measured, in terms of B800, in mT. These are tabulated below (Table 6).

What is claimed is:

1. In a process for production of silicon steel sheet having the high magnetic characteristics, in which said silicon steel consists of from 2.5% to 4.5% by weight of silicon; from 150 to 750 ppm, of C; from 300 to 4000 ppm, of Mn; less than 120 ppm of S; from 100 to 400 ppm of $Al_{sol}$; from 30 to 130 ppm, of N; and less than 50 ppm, of Ti; the remainder consisting of iron and minor impurities, undergoes continuous casting to form slabs, high-temperature annealing, hot-rolling to obtain a hot-rolled strip, coiling the hot-rolled strip and allowing said hot-rolled strip to cool, heat-treating, pickling, and cold rolling in a single stage or in more than one stage, the cold rolled-strip thus obtained being continuously annealed to carry out primary re-crystallization and decarburization, then coated with annealing separator, and box-annealed for a secondary-recrystallization final treatment, the improvement which comprises the combination of the following steps:

carrying out on the continuously cast slabs a high temperature annealing comprising an equalization heat treatment at a temperature of between 1200° C. and 1320° C.;

hot rolling the slabs thus obtained, and coiling the resultant hot rolled strip at a temperature of less than 700° C.;

heating the hot rolled strip to a temperature of between 1000° C. and 1150° C., with subsequent cooling down to and stopping at a temperature of between 800° C. and 950° C., followed by quenching;

carrying out a continuous decarburization annealing of the cold-rolled strip for a total time of between 50 and 350 sec, at a temperature of between 800° C. and 950° C. in a wet nitrogen-hydrogen atmosphere, with $pH_2O/pH_2$ ranging between 0.3 and 0.7;

carrying out a continuous nitriding annealing at a temperature of between 850° C. and 1050° C., for a period of time of between 15 and 120 sec, feeding into the furnace a nitrogen-hydrogen based gas containing $NH_3$ in quantities of between 1 and 35 standard liters per kg of strip, with a water-vapor content of between 0.5 and 100 $g/m^3$ wherein the box annealing for secondary-recrystallization is carried out for 2 to 20 hours at a temperature of between 700° C. and 1200° C.

2. Process according to claim 1, wherein the continuously cast slabs have the following composition: Si, from 2.5% to 3.5% by weight; C, between 250 and 550 ppm; Mn, between 800 and 1500 ppm; soluble Al, between 250 and 350 ppm; N, between 60 and 100 ppm; S, between 60 and 80 ppm; and Ti, less than 40 ppm; the remainder consisting of iron and other minor impurities.

3. Process according to claim 1, wherein the temperature of equalization of the slabs is between 1270° C. and 1310° C.

4. Process according to claim 1 wherein the hot rolled strip is heated to a temperature of between 1060° C. and 1130° C.

5. Process according to claim 1, wherein the stop temperature of the hot-rolled strip, when cooled after said rolled strip is heated is between 900° C. and 950° C.

6. Process according to claim 5 wherein the hot-rolled strip is cooled down to a temperature of 900–950° C., maintained at this temperature and then cooled down to a temperature of 700–800° C., after which said strip is quenched in water and water vapor.

7. Process according to claim 1, wherein the cold-rolling temperature is kept at a value of between 180° C. and 250° C. in two intermediate rolling passes.

8. Process according to claim 4 wherein cold-rolling is carried out in a single stage, at a rolling temperature of at least 180° C. in at least one of the rolling passes.

9. Process according to claim 7, wherein the cold-rolling temperature is between 200° C. and 220° C. in two intermediate passes.

10. Process according to claim 1 wherein the decarburization temperature is between 830° C. and 880° C., and the subsequent nitriding annealing is carried out at a temperature of at least 950° C.

11. Process according to claim 1, wherein the nitriding annealing is carried out for an interval of time between 15 and 120 sec.

12. Process according to claim 11, wherein the content of ammonia in the nitriding gas fed into the furnace is between 1 and 9 standard liters per kg of strip treated.

13. Process according to claim 1, wherein the holding time at a temperature of between 700° C. and 1200° C. is less than 4 hours.

14. In a process for the production of silicon steel sheet having high magnetic characteristics, in which said silicon steel containing from 2.5% to 4.5% by weight of silicon; from 250 to 500 ppm, of C; from 300 to 4000 ppm, of Mn; from 50 to 70 ppm, of S; from 200 to 350 ppm, of $Al_{sol}$; from 60 to 100 ppm, of N; and less than 30 ppm, of Ti; the remainder consisting of iron and mirror impurities, undergoes continuous casting to form slabs, high-temperature annealing to obtain a hot-rolled strip, cooling the hot-rolled strip and allowing said hot-rolled strip to cool, uncoiling the hot rolled strip, heat-treating, pickling, hot-rolling, and cold rolling in a single stage or in more than one stage, the cold rolled-strip thus obtained being continuously annealed to carry out primary re-crystallization and decarburization, then coated with annealing separator, and box-annealed for a secondary-recrystallization final treatment, wherein the improvement comprises the following steps in a cooperative relationship:

carrying out on the continuously cast slabs a high temperature annealing comprising an equalization heat treatment at a temperature of between 1200° C. and 1320° C.;

hot rolling the slabs thus obtained, and coiling the resultant hot rolled strip at a temperature of less than 700° C.;

heating said hot-rolled strip to a temperature of between 1000° C. and 1150° C., with subsequent cooling down to and stopping at a temperature of between 800° C. and 950° C., followed by quenching;

carrying out a continuous decarburization annealing of the cold-rolled strip for a total time of between 50 and 350 sec., at a temperature of between 800° C. and 950° C. in a wet nitrogen-hydrogen atmosphere, with $pH_2O/pH_2$ ranging between 0.3 and 0.7;

carrying out a continuous decarburization annealing of the cold-rolled strip for a total time of between 50 and 350 sec., at a temperature of between 800° C. and 950° C. in a wet nitrogen-hydrogen atmosphere, with $pH_2O/pH_2$ ranging between 0.3 and 0.7;

carrying out a continuous nitriding annealing at a temperature of between 850° C. and 1050° C., for a period of time of between 15 and 120 sec., feeding into the furnace a nitrogen-hydrogen based gas containing $NH_3$ in quantitites of between 1 and 35 standard liters per kg of strip, with a water vapor content of between 0.5 and 100 $g/M^3$ wherein the box annealing for secondary-recrystallization is carried out for 2 to 20 hours at a temperature of between 700° C. and 1200° C.

* * * * *